US007475435B2

(12) United States Patent
Van Atta et al.

(10) Patent No.: US 7,475,435 B2
(45) Date of Patent: Jan. 13, 2009

(54) SWIM GOGGLES

(75) Inventors: Dylan S. Van Atta, Portland, OR (US); Alan W. Reichow, Forest Grove, OR (US); Karl M. Citek, Forest Grove, OR (US); Robert M. Bruce, Portland, OR (US)

(73) Assignee: Nike, Inc., Beaverton, OR (US)

( * ) Notice: Subject to any disclaimer, the term of this patent is extended or adjusted under 35 U.S.C. 154(b) by 214 days.

(21) Appl. No.: 10/785,203

(22) Filed: Feb. 23, 2004

(65) Prior Publication Data

US 2005/0193479 A1 Sep. 8, 2005

(51) Int. Cl.
*A61F 9/02* (2006.01)

(52) U.S. Cl. ..... 2/440; 2/431; 351/43

(58) Field of Classification Search ..... 2/426, 2/428, 440, 442, 436, 11, 12, 15, 431, 432; 351/43, 41, 47; 128/858
See application file for complete search history.

(56) References Cited

U.S. PATENT DOCUMENTS

| | | | | |
|---|---|---|---|---|
| 2,928,097 | A | 3/1960 | Neufeld | |
| 3,671,976 | A | 6/1972 | Johnson et al. | |
| 3,944,345 | A | 3/1976 | Decorato | |
| 4,006,974 | A | 2/1977 | Resnick | |
| 4,286,340 | A | 9/1981 | Lathrop | |
| 4,467,799 | A | 8/1984 | Steinberg | |
| 4,468,819 | A | 9/1984 | Ohno | |
| 4,704,014 | A | 11/1987 | Carner, Jr. | |
| 5,162,823 | A | 11/1992 | Goldstein | |
| 5,170,190 | A | 12/1992 | Berke | |
| 5,204,700 | A | 4/1993 | Sansalone | |
| 5,216,454 | A | 6/1993 | Berke | |
| 5,331,691 | A * | 7/1994 | Runckel | 2/428 |

(Continued)

FOREIGN PATENT DOCUMENTS

| | | |
|---|---|---|
| JP | 6165797 | 6/1994 |

(Continued)

OTHER PUBLICATIONS

Press Release, "Adhesive Eyewear Helps Sports Competitors Stick With It," 1 page (Jan. 2003).

(Continued)

*Primary Examiner*—Katherine Moran
(74) *Attorney, Agent, or Firm*—Shook, Hardy & Bacon LLP

(57) ABSTRACT

The present invention concerns embodiments of swim goggles. In one embodiment, the goggles include a pair of eyepieces that are not interconnected by a nose piece or a head strap. Each eyepiece includes a transparent lens portion that covers an eye and a peripheral frame portion surrounding a respective lens portion. The frame portion of each eyepiece has a posterior surface that carries an adhesive layer (e.g., a layer of adhesive tape) for adhesively securing the eyepiece to the skin adjacent the eyes. In another embodiment, the eyepieces can be interconnected by a nose piece and a head strap. The lens portion of each eyepiece includes a flat, anterior lens and a flat, side lens that is connected to a temporal edge of the anterior lens and is inclined away from the anterior lens to reduce hydrodynamic drag and optical distortion.

27 Claims, 7 Drawing Sheets

U.S. PATENT DOCUMENTS

| | | | | | |
|---|---|---|---|---|---|
| 5,345,615 | A | | 9/1994 | Garofalo | |
| 5,420,649 | A | | 5/1995 | Lewis | |
| 5,515,551 | A | * | 5/1996 | Yashiro | 2/428 |
| 5,546,611 | A | * | 8/1996 | Lathrop | 2/428 |
| 5,813,056 | A | | 9/1998 | Ambrose | |
| 5,896,588 | A | * | 4/1999 | Chiang | 2/428 |
| 5,896,589 | A | | 4/1999 | Chou | |
| 5,940,892 | A | * | 8/1999 | Morgan | 2/430 |
| 5,950,248 | A | | 9/1999 | Kawashima et al. | |
| 6,006,367 | A | | 12/1999 | Webster | |
| 6,009,564 | A | | 1/2000 | Tackles et al. | |
| 6,019,103 | A | | 2/2000 | Carroll | |
| 6,023,791 | A | | 2/2000 | Chiang | |
| 6,098,205 | A | | 8/2000 | Schwartz et al. | |
| 6,098,628 | A | | 8/2000 | Funk | |
| 6,112,334 | A | | 9/2000 | Chiang | |
| 6,131,208 | A | * | 10/2000 | Banks | 2/432 |
| 6,282,728 | B1 | | 9/2001 | Baragar et al. | |
| 6,341,863 | B1 | * | 1/2002 | Chen-Lieh | 351/43 |
| 6,343,386 | B1 | | 2/2002 | Chou | |
| 6,460,995 | B1 | | 10/2002 | Chen-Lieh | |
| 6,574,802 | B2 | * | 6/2003 | Chiang | 2/428 |
| 6,609,255 | B2 | * | 8/2003 | Lane et al. | 2/431 |
| 2004/0169814 | A1 | | 9/2004 | Bleau | |
| 2004/0218140 | A1 | | 11/2004 | Bleau | |

FOREIGN PATENT DOCUMENTS

| | | | |
|---|---|---|---|
| TW | 415838 | B | 12/2000 |
| WO | WO 00/00235 | | 1/2000 |
| WO | WO 2004/010912 | | 2/2004 |

OTHER PUBLICATIONS

Official Letter from the Intellectual Property Office of Taiwan, dated Apr. 18, 2006, for corresponding Taiwan Application No. 94102140 and English translation.

Kast-A-Way Swimwear: Product: 'X-Sight Goggle' (website), http://www.kastawayswimwear.com/product.asp?dept%5Fid=19&pf%5Fid=2069, 1 page.

* cited by examiner

SWIM GOGGLES

FIELD

The present disclosure relates to embodiments of swim goggles.

BACKGROUND

Swim goggles used to isolate a swimmer's eyes from the surrounding water are well known. Conventional swim goggles typically include a pair of spaced-apart eyepieces that are worn over the eyes, a nose band that extends over the nose, and an elastic strap that extends around the rear of the head. Such goggles typically surround the orbit (eye socket) to protect the eye and improve underwater vision by providing a corneal/air interface instead of exposing the cornea directly to an aqueous environment.

Two primary design considerations that drive the design of swim goggles are minimizing hydrodynamic drag and minimizing visual distortion. Hydrodynamic drag creates resistance to the swimmer's forward movement through the water, thereby reducing the swimmer's velocity through the water. Therefore, in order to maximize their velocity when racing or otherwise moving through the water, swimmers need to reduce water resistance or hydrodynamic drag as much as possible. Reducing hydrodynamic drag is of particular importance in sprinting events, such as the 100-meter freestyle, where time differences between swimmers are frequently measured in fractions of a second.

Cylindrical goggles employing planar lenses positioned perpendicular to the normal line of sight can provide relatively distortion free vision, but such goggles unfortunately exhibit high resistance to water flow past the lenses. To reduce hydrodynamic drag, it is known to increase the curvature of the lenses so that water can flow more easily over the lenses with less resistance. Unfortunately, such lenses tend to distort an image transmitted to the eye, and many users are unwilling to sacrifice visual clarity for reduced drag.

Accordingly, there is a continuing need for new and improved swim goggles, and especially for goggles that minimize hydrodynamic drag and/or minimize visual distortion.

SUMMARY

According to one aspect, the present disclosure provides a set of strapless swim goggles that includes a pair of eyepieces that isolate the swimmer's eyes from the outside environment. Unlike conventional swim goggles, the eyepieces are not interconnected with each other by a head strap or a nose piece. Instead of a strap, the eyepieces desirably are retained against the swimmer's face using an adhesive applied to the eyepieces. The adhesive can be, for example, a layer of an adhesive tape. In an alternative embodiment, the goggles are not interconnected by a head strap, but may have a nose piece connected to the nasal end portions of the eyepieces.

In particular embodiments, each eyepiece includes a transparent, non-corrective lens portion that covers an eye and a peripheral frame portion that is shaped to at least partially conform to the shape of the orbital rim, for example, by seating against or adjacent (for example, slightly within) the orbital rim. The frame portion of each eyepiece has a posterior surface that in some embodiments carries a layer of an adhesive tape for securing the frame portion to the skin adjacent the eye. In addition, the frame portions desirably are sized and shaped to allow a swimmer to retain the eyepieces in place by contracting the orbicularis oculi muscles (the muscles surrounding the eye sockets) against the frame portions.

A significant advantage of one embodiment of the goggles is that it reduces hydrodynamic drag as the swimmer moves through the water. This embodiment of the goggles reduces hydrodynamic drag in at least two ways. First, the hydrodynamic drag caused by the presence of a strap and a nose piece in conventional goggles is completely eliminated. Second, the frame portions of the eyepieces surrounding the lenses do not include any connection points for connecting to a strap or nose piece. As such, the frame portions can be formed with a smooth, continuous surface, which allows water to pass over the goggles more efficiently. The goggles are particularly advantageous in sprinting events (e.g., the 100-meter freestyle), where a relatively small reduction in overall drag can result in a significantly faster performance for a swimmer.

According to another aspect, hydrodynamic drag can be further reduced by minimizing the anterior-posterior depth or profile of eyepieces so that water can flow more easily and quickly from the forehead over the eyes as the swimmer moves through the water. Also, by minimizing the depth of the eyepieces, the lenses are moved closer to the eyes, which improves peripheral vision by increasing the horizontal and vertical viewing angles of the eyepieces. In particular embodiments, the eyepieces have a minimum depth of less than 8 mm, with 5.75 mm being a specific example.

According to another aspect, the lens of each eyepiece includes a substantially flat, anterior lens portion that is positioned in front of the eye in an as worn orientation and a substantially flat side lens portion that is connected to the temporal edge of the anterior lens portion. In particular embodiments, the anterior lens is substantially perpendicular to the normal straight ahead line of sight, while the side lens portion is substantially perpendicular to a secondary temporally oriented line of sight. The side lens portion being inclined away from the anterior lens portion reduces hydrodynamic drag. This embodiment can include a conventional nose piece and head strap to retain the goggles in the as worn position over the eyes, although other embodiments are strapless eyepieces that are retained by the orbicularis oculi muscles and/or adhesive as already described.

The angled side lens portion is also effective to enhance the optical properties of the lens. For example, since the side lens portion reduces the distance between the eye and the lens in the temporal field of vision, it increases the horizontal viewing angle through the temporal portion of the lens. In addition, the inclined side lens portion mitigates the effect of prismatic deviation caused by the refraction of light through the temporal portion of the lens as compared to an eyepiece having only a flat anterior lens. The inclined side lens portion also eliminates the power and distortion induced by the curved annular peripheral wall that would otherwise be at that location of the eyepiece. Hence, the orientation of the side lens portion improves the overall optical clarity of the lens.

The foregoing and other features and advantages of the invention will become more apparent from the following detailed description of several embodiments, which proceeds with reference to the accompanying figures.

DETAILED DESCRIPTION

As used herein, the singular forms "a," "an," and "the" refer to one or more than one, unless the context clearly dictates otherwise.

As used herein, the term "includes" means "comprises."

As used herein, the term "line of sight" is used generically to refer to the visual fixation axis that extends through the center of the pupil and the center of rotation of the eye. A "normal line of sight" is the straight ahead line of sight or sight along the visual axis that the eye assumes in the primary position, looking straight ahead into the distance. A "temporal line of sight" is a secondary line of sight that the eye assumes when rotated temporally (toward the temple).

Figure 1:
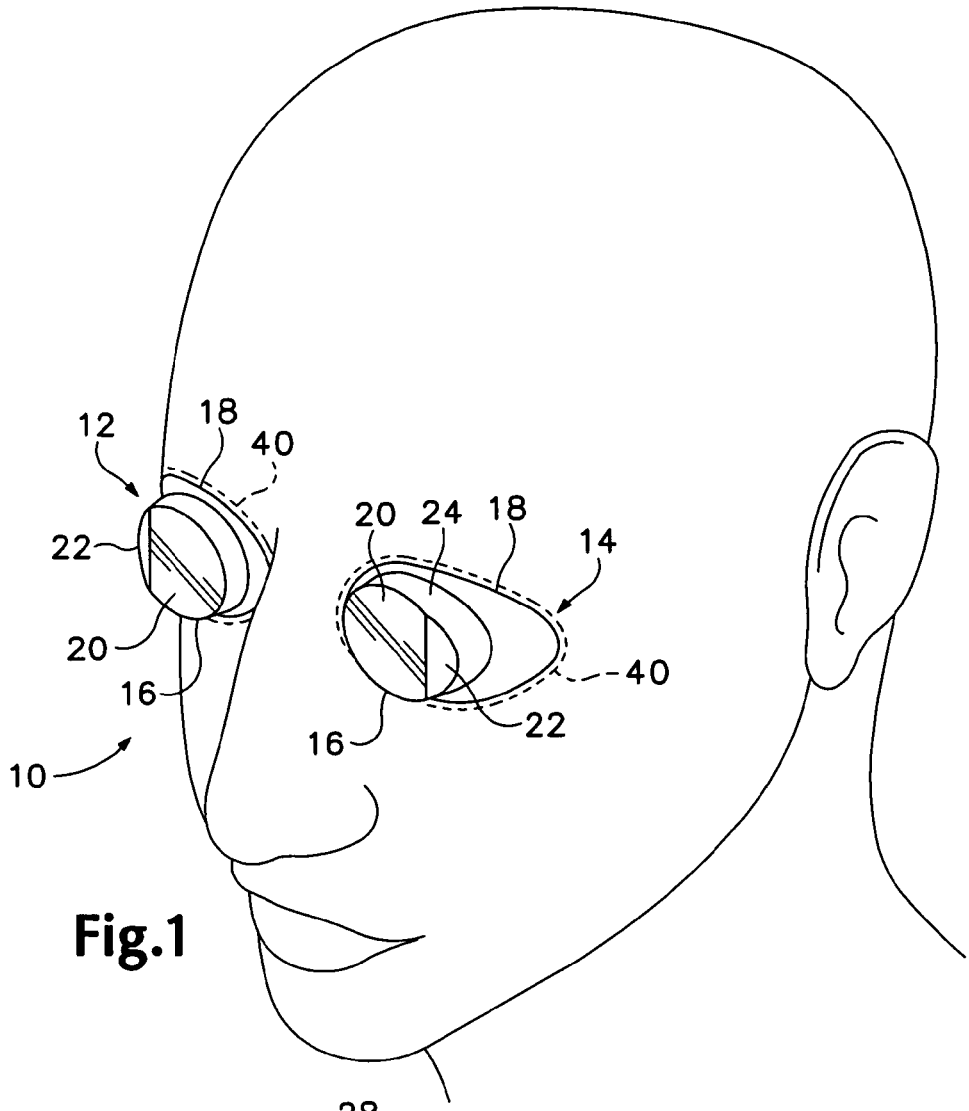
FIG. 1 is a schematic perspective view of a human head shown with a pair of strapless swim goggles, according to one embodiment, placed over the eyes. The orbicularis oculi muscles are illustrated around each eye.
Figure 2:
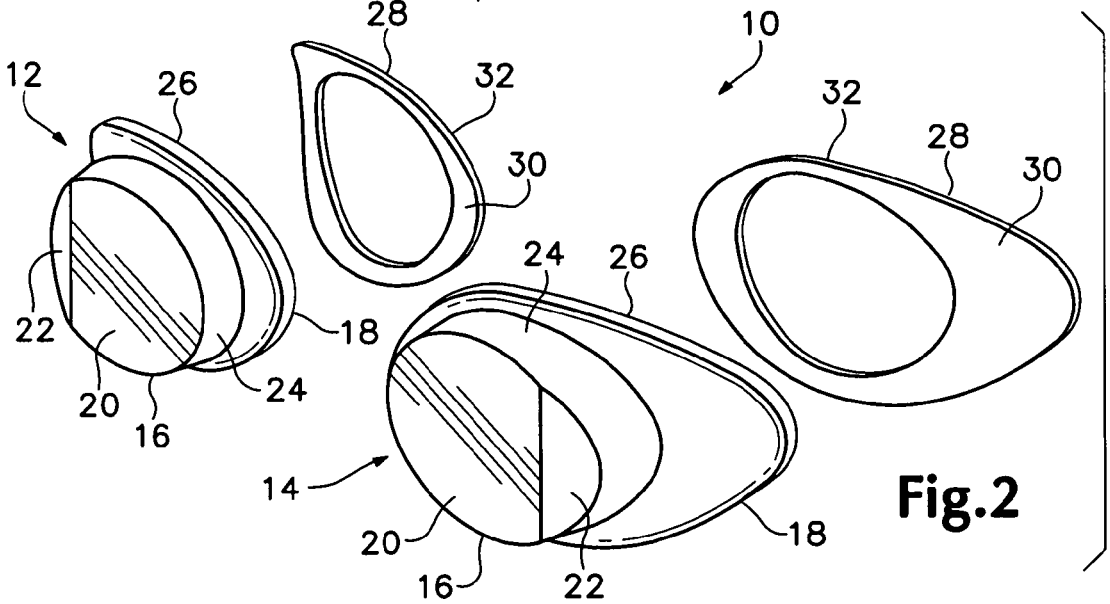
FIG. 2 is an exploded perspective view of the goggles shown in FIG. 1.
Figure 3:
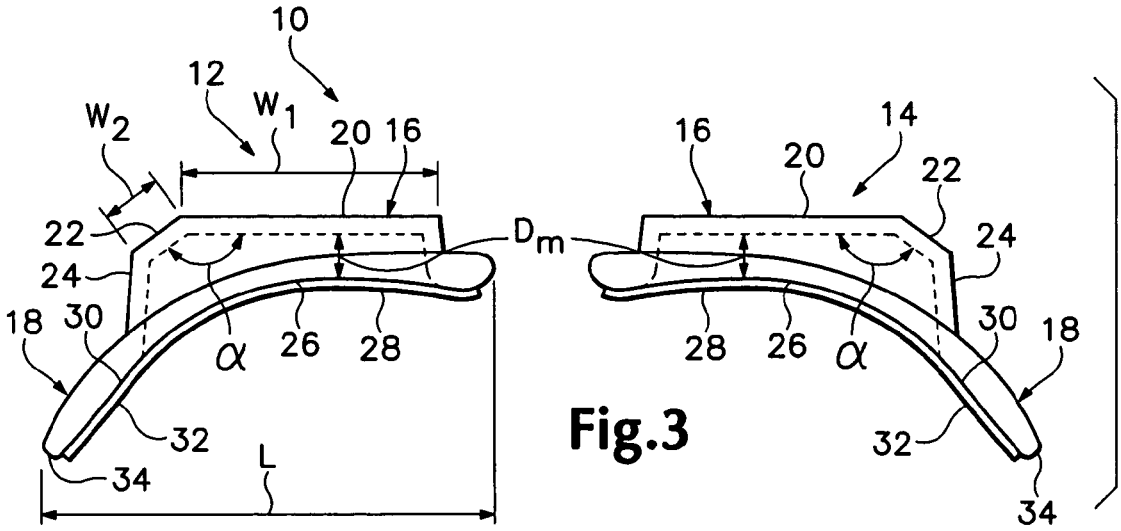
FIG. 3 is a top plan view of the goggles shown in FIG. 1.
Figure 4:
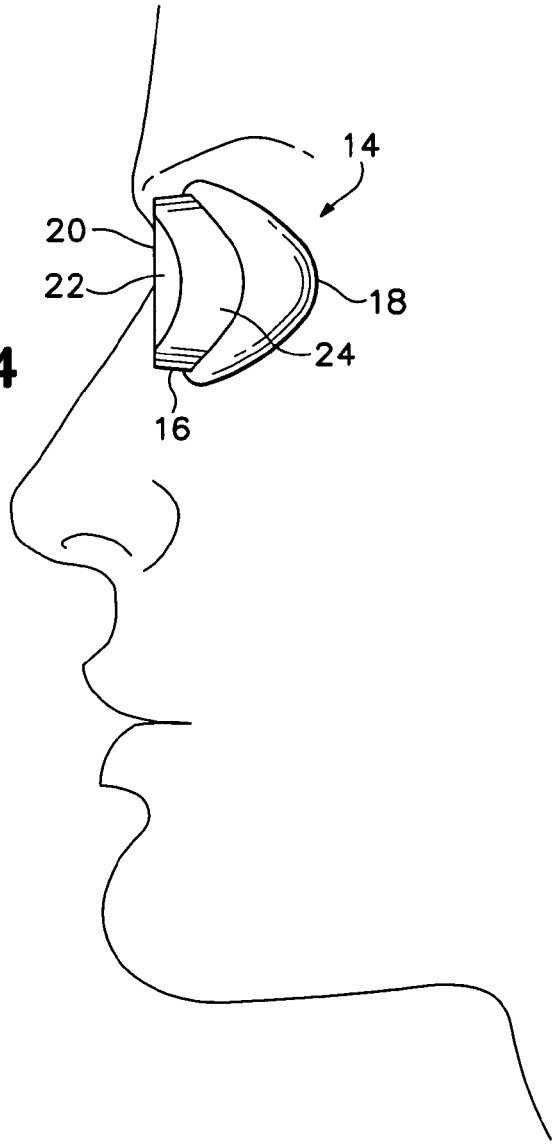
FIG. 4 is side view of the head and goggles shown in FIG. 1.

FIGS. 1-3 illustrate a set of goggles 10, according to one embodiment, which includes right and left eyepieces 12, 14, respectively, configured to isolate a user's eyes from the surrounding environment. Each eyepiece 12, 14 comprises a body having a transparent lens portion 16 for covering an eye and a curved peripheral frame portion or flange 18 surrounding and supporting the lens portion 16. The curve of the frame substantially conforms to the contour of a human face from the nose to the orbital rims. The frame portions 18 have respective posterior surfaces 26 that are configured to be placed adjacent the skin of the user. Each eyepiece 12, 14 desirably is constructed from a relatively stiff and hard transparent plastic, with good scratch resistance and optical qualities. A suitable plastic is an impact-resistant polycarbonate material, although various other materials also can be used.

The lens portions 16 of the eyepieces 12, 14 can have any of various configurations. In the illustrated embodiment, for example, each lens portion 16 includes a flat anterior lens portion 20 and a flat, temporally inclined side lens portion 22 that intersects the anterior lens portion 20 at an obtuse angle $\alpha$ (FIG. 3) so as to reduce hydrodynamic drag. The side lens portion 22 also functions to improve the optical properties of the eyepieces, as discussed in detail below. An annular peripheral wall 24 of each lens portion 16 surrounds a respective anterior lens portion 20 and a respective temporal side lens portion 22, and connects the anterior lens portion 20 and side lens portion 22 to a respective frame portion 18. The temporal ends 34 of the frame portions 18 in the illustrated embodiment extend to about the anterior margins of the temporal bones (for example, the zygoma).

Other lens configurations also can be implemented in the goggles. For example, inclined side lens portion 22 can be oriented in a non-temporal direction with respect to anterior lens portion 20, such as substantially in one of the other cardinal directions (superior, superior-temporal, superior-nasal, nasal, inferior, inferior-temporal, and inferior-nasal) or in a direction intermediate two of the cardinal directions. Additionally, multiple flat, inclined lens portions can be connected to the anterior lens portion 20 at respective locations. Alternatively, each lens portion 16 can be formed with a flat anterior lens portion 20, a curved peripheral wall 24, but without an inclined lens portion (e.g., side lens portion 22).

As another example, each lens portion can be formed with a curved, convex anterior surface, rather than the flat anterior lens surface shown in the illustrated embodiment. In addition, the lens portions 16 can have various tints or coatings (e.g., an anti-reflection coating), as known in the art.

The eyepieces 12, 14 are configured to form a substantially water-tight seal with the face of a wearer in order to keep water away from the wearer's eyes. Additionally, the frame portions 18 of the eyepieces 12, 14 desirably are configured to enable the wearer to assist in retaining the eyepieces against the face through contraction of the orbicularis oculi muscles 40 (FIG. 1) against the upper and lower edges of the frame portions. These muscles form a ring or sphincter that circumscribes the eye and extends over and around the entire orbital rim. Contraction of these muscles reduces the opening of the sphincter, and is normally used to tightly close the eyes. The frame portions 18 are constructed to generally relate to the shape of the orbital rims and orbicularis muscles such that at least portions of the frame portions seat against and/or fit just within the orbital rims, and contraction of the orbicularis oculi muscles selectively firmly retains eyepieces 12, 14 in front of the eyes.

Figure 5:
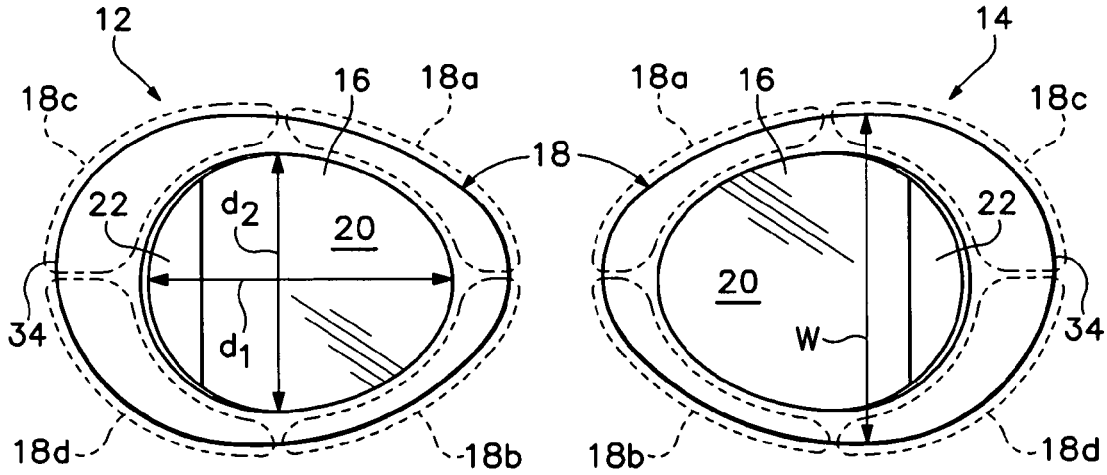
FIG. 5 is a front view of the goggles shown in FIG. 1.

For example, referring to FIG. 5, the frame portions 18 are depicted as having upper and lower nasal portions 18*a* and 18*b*, respectively, and upper and lower temporal portions 18*c* and 18*d*, respectively. The frame portions 18 in one specific embodiment are sized and shaped such that at least the upper and lower nasal portions 18*a*, 18*b* or portions thereof can be positioned within the adjacent margins of the orbital rims, or within the outer margins of the orbicularis oculi muscles. The posterior surface 26 (FIG. 3) of the upper and lower nasal portions 18*a*, 18*b* generally seats against soft tissue within the orbital rim, or against the fibers of the orbicularis oculi muscles, and posterior surface 26 of the upper and lower temporal portions 18*c* and 18*d*, respectively, generally seats against the adjacent temporal margins of the orbital rims. It is not necessary that the entire frame fit within the orbital rim or be engageable by the orbicularis oculi muscles. It is possible, for example, that the muscles only engage and retain a portion (such as a nasal or temporal portion) of the frame. In addition, the wearer can effect the exact positioning of the eyepieces with respect to the orbital rims. For example, by angling the anterior lens portion 20 slightly downwardly with respect to the normal line of sight, a wearer can position an eyepiece such that the upper nasal portion 18*a*, the lower nasal portion 18*b*, and the lower temporal portion 18*d* except for the extreme temporal end 34 are positioned within the orbital rim. In addition, the positioning of the frame portions 18 relative to the orbital rims can vary slightly depending on the facial morphology of the wearer.

In an alternative embodiment, the frame portions 18 can be sized and shaped to fit substantially or entirely within the orbital rims. In another alternative embodiment, the frame portions 18 can be sized and shaped to reside completely outside the orbital rims.

Dimensions of the frame that can be retained by the orbicularis oculi muscles may be determined using many different approaches. For example, the goggles can be custom designed and fitted to a particular individual. Alternatively, the dimensions can be determined by reference to a standard head form that has been designed according to statistical norms from the population, or from published texts and descriptions of such norms. Examples of such head forms are the Canadian and Alderson head forms.

In the illustrated embodiment, each eyepiece 12, 14 has a one-piece or unitary construction, although this is not a requirement. In an alternative embodiment, for example, the lens portions 16 and the frame portions 18 are separately formed and then subsequently joined together to form the eyepieces. The lens portions 16 can be either permanently attached to the frame portions 18 or connected to the frame portions in a removable manner. In this alternative embodiment, the frame portions 18 need not be constructed from the same material as the lens portions 16.

Each eyepiece 12, 14 in the illustrated embodiment provides a substantially zero power or non-corrective lens. However, if desired, anterior lens 20 and/or side lens 22 of lens portion 16 can be corrective lenses having optical power to compensate for the refractive error of the wearer. Such corrective lenses can have a planar anterior surface and a slightly curved posterior surface to introduce optical power in the lens. In another embodiment, a separate corrective lens can be shaped and sized to be received in the eyepiece against the posterior surface of the anterior lens 20.

To assist in retaining the eyepieces 12,14 against the face of the user, each eyepiece can optionally have an adhesive layer, such as the illustrated adhesive tape layer 28 (FIGS.2 and 3 ), overlaying the posterior surface 26 Each adhesive tape layer 28 can be conventional "double-sided" or "double-coated" tape having a first adhesive surface 30 secured to the posterior surface 26 of the respective eyepiece and a second adhesive surface 32 that is placed against the skin of the user. Each eyepiece 12, 14 can include a removable, protective cover layer (not shown) overlaying the second adhesive surface 32 of the tape to protect the second adhesive surface from adhering to extraneous matter prior to use. In certain embodiments, the eyepieces can be provided with two pieces of double-sided adhesive tape that are shaped to be applied to the posterior surfaces of the eyepieces and a set of instructions for informing a user how to apply the tape to the eyepieces.

The second adhesive surface 32 desirably exhibits a bonding strength suitable to adhere the eyepieces 12, 14 to the skin of the user during normal conditions of use (e.g., when swimming), yet allows the eyepieces to be removed with minimal discomfort. The first adhesive surface 30 of the tape desirably provides a bonding strength sufficient to prevent separation of the tape from the eyepieces during normal conditions of use, yet allows the tape to be peeled away from the posterior surfaces 26 of the eyepieces to permit replacement of the tape when the adhesion strength of the second adhesive surface deteriorates from multiple uses and the tape no longer adheres to the skin. In addition, the tape desirably includes a layer of a deformable material, such as polyethylene foam, to provide a sealing surface that better accommodates uneven facial surfaces. One example of a replaceable adhesive tape that can be used to form adhesive tape layers 28 is Bioflex™ Rx416VSA double-sided mounting tape, available from Scapa North America of Windsor, Conn.

In lieu of the illustrated tape layers 28, a layer of a suitable adhesive (e.g., acrylic) can be formed directly on the posterior surfaces 26 of the eyepieces. This alternative embodiment may require a new layer of adhesive to be applied to the eyepieces after multiple uses to ensure a suitable bond against the skin. In yet another embodiment, the eyepieces are not provided with any adhesive layers to assist in retaining the eyepieces in place against the user's face.

Referring to FIG. 3, each eyepiece has a variable depth measured between the inner or posterior surface of the anterior lens portion 20 and the posterior surface 26 of the frame 18. As shown, each eyepiece has a minimum depth, $D_m$, measured at the nasal end of the anterior lens portion 20, and the depth increases from the nasal end to the temporal end of the anterior lens portion. The minimum depth $D_m$ desirably is minimized so that water can flow more easily and quickly from the forehead over the eyepieces as the swimmer moves through the water. In particular embodiments, the eyepieces have a minimum depth $D_m$ of less than 8.00 mm, with 5.75 mm being a specific example.

Figure 6:
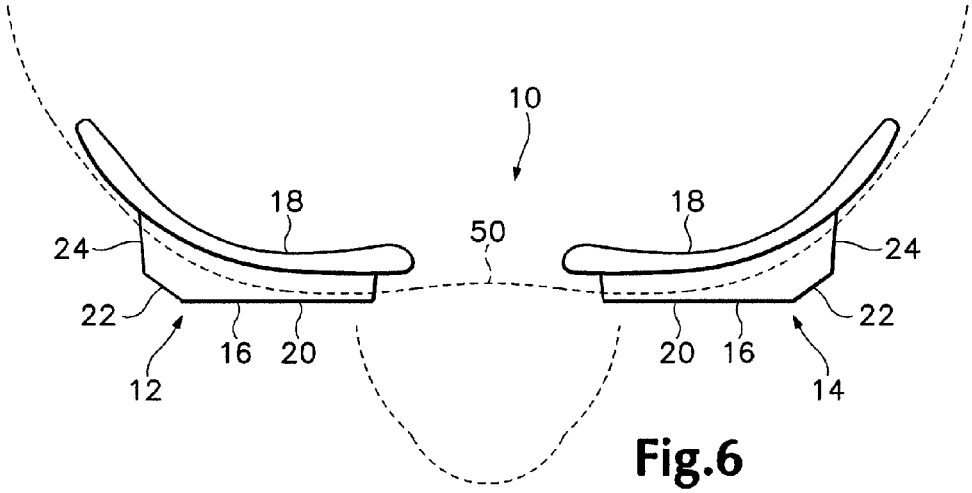
FIG. 6 is a top plan view similar to FIG. 3, showing the goggles in an as worn orientation.
Figure 7:
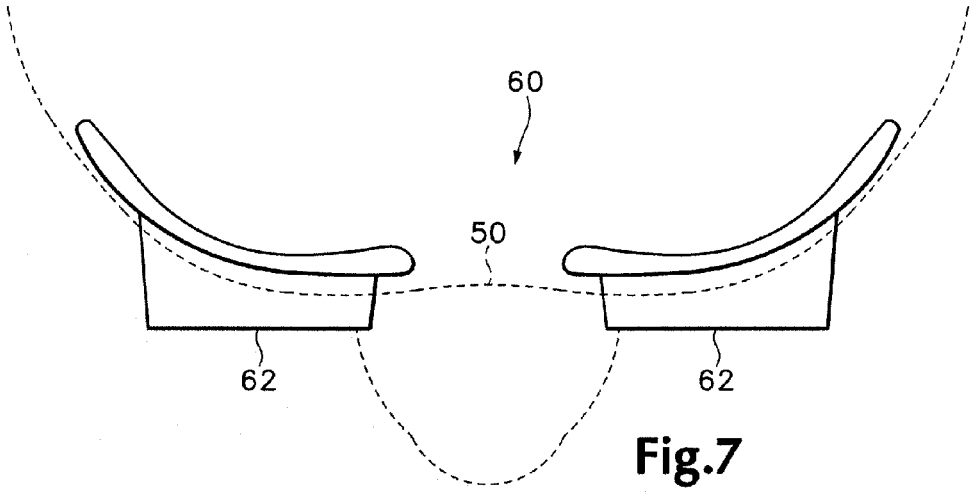
Fig.7 (Prior Art)
FIG. 7 is a top plan view of a typical conventional pair of swim goggles shown in the as worn orientation, with the nose piece and head strap removed for clarity.

FIG. 6 illustrates a top view of the human head with the goggles 10 shown in an as worn orientation. For comparison, FIG. 7 depicts a pair of conventional swim goggles 60 (with the nose piece and head strap removed for clarity) shown in an as worn orientation. As can be seen, the anterior surfaces 20 of goggles 10 (FIG. 6) are closer to the brow 50 than are the anterior surfaces 62 of goggles 60. This reduces hydrodynamic drag and allows the swimmer to increase swimming velocity through the water. Another advantage of minimizing the depth of the goggles is that it reduces optical distortion and enhances the swimmers field of view, as further described below.

When mounting the goggles, the user first opens his or her eyes wide so as to expand the orbicularis oculi muscles, positions the eyepieces 12, 14 over the eyes as previously described, and presses the eyepieces against the face so as to ensure a good bond between the tape layer 28 and the skin. Pressing the eyepieces against the face tends to create a small vacuum between the eyes and the eyepieces. This vacuum assists in retaining the eyepieces against the face during use. When the eyepieces are properly positioned, the orbicularis oculi muscles can be relaxed or further contracted against the upper and lower edges of the frame portions 18 to assist in comfortably retaining the eyepieces in place.

In use, a swimmer can expand or contract the orbicularis oculi muscles as needed to adjust the firmness with which the eyepieces are retained by these muscles. For example, when diving into a pool at the start of a race, the swimmer can contract the orbicularis oculi muscles tightly against the frame portions 18 to ensure that the eyepieces do not come off upon entry into the water.

By eliminating the strap and nose piece for interconnecting the eyepieces, such as used in conventional goggles, and by minimizing the depths of the eyepieces, the goggles 10 reduce the overall hydrodynamic drag of a swimmer. The goggles 10 are particularly advantageous in sprinting events, where a relatively small reduction in overall drag can result in a significant reduction in overall time for a swimmer.

EXAMPLE 1

In one specific embodiment of the goggles 10, each eyepiece 12, 14 has a minimum depth $D_m$ of about 5.75 mm, an overall length L (FIG. 3) of about 6 cm measured between the nasal and temporal ends of the frame portion 18, and a maximum width W (FIG. 5) 3.7 cm measured between the upper and lower edges of the frame portion 18. Frame 18 has a radius of curvature that varies in the nasal-temporal direction to substantially conform to the shape of the head. The lens portion 16 of each eyepiece has a major diameter $d_1$ and a minor diameter $d_2$ (FIG. 5) measured in the plane of the anterior lens portion 20 of about 3.5 cm and 2.9 cm, respectively. The anterior lens 20 has a nasal-temporal width $W_1$ (FIG. 3) of about 3.039 cm measured along the major diameter $d_1$, and the side lens 22 has a nasal-temporal width $W_2$ (FIG. 3) of about 0.707 cm. In addition, the side lens 22 is oriented at an angle $\alpha$ of about 144° with respect to the anterior lens 20. Of course, these specific dimensions (as well as other dimensions provided in the present specification) are given to illustrate the invention and not to limit it. The dimensions provided herein can be modified as needed in different applications or situations.

EXAMPLE 2

This example demonstrates the hydrodynamic drag of a pair of strapless goggles having the same configuration as the embodiment shown in FIGS. 1-4, a pair of commercially available "Swedish" goggles (i.e., goggles without a deformable seal around the eyepieces), and another pair of commercially available goggles used in competitive swimming. The eyepieces of the strapless goggles had a depth $D_m$ of about 5.75 mm.

To determine hydrodynamic drag, each pair of goggles was placed on the head of a life-size mannequin positioned in a tow tank. The mannequin was positioned face down with the arms extended and pointed forward. Drag measurements for each pair of goggles were recorded at water velocities of 1.950 m/s, 2.025 m/s, 2.1 m/s, 2.175 m/s and 2.250 m/s. The recorded drag measurements were normalized through conversion to non-dimensional drag coefficients. Statistical regression was used to convert the drag coefficients to estimated drag at a velocity of 2.10 m/s.

The results of this evaluation are summarized in Table 1. As shown in Table 1, the strapless goggles actually reduced the overall drag of the bare mannequin by about 0.073 kg. This reduction is a consequence of the eyepieces fairing the eye sockets of the mannequin. The difference in drag between the strapless goggles and goggles A is 0.339 kg, and the difference in drag between the strapless goggles and goggles B is 0.481 kg. In the 100-m freestyle, the differences in drag would result in about a 0.678-second advantage over goggles A and about a 0.962-second advantage over goggles B.

TABLE 1

| Type of Goggles | Estimated Drag (kg) @ 2.1 m/s | Difference from bare mannequin (kg) | Estimated time savings (−) or addition (+) in the 100-m freestyle |
|---|---|---|---|
| Bare mannequin (without goggles) | 9.934 | N/A | N/A |
| Mannequin with strapless goggles | 9.861 | −0.073 | −0.146 seconds |
| Mannequin with goggles A (commercially available racing goggles) | 10.200 | +0.266 | +0.532 seconds |
| Mannequin with goggles B (commercially available Swedish goggles) | 10.342 | +0.408 | +0.816 seconds |

Figure 8:
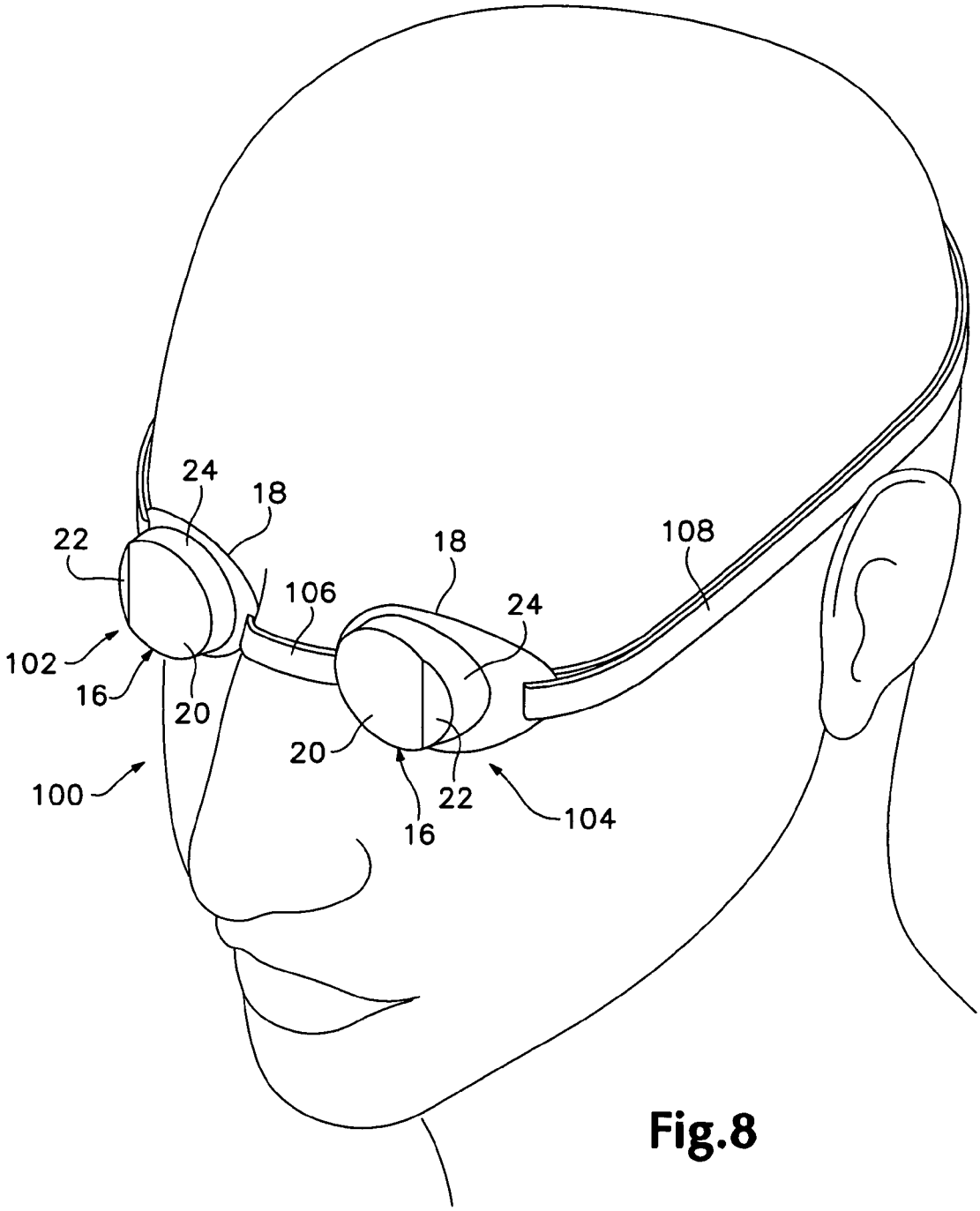
FIG. 8 is a schematic perspective view of a human head and a pair of swim goggles, according to another embodiment, placed over the eyes.

FIG. 8 illustrates a set of goggles 100, according to another embodiment. The goggles 100 include right and left eyepieces 102 and 104, respectively, that have a construction that is similar to the eyepieces 12, 14 of goggles 10 shown in FIGS. 1-6. Hence, components in FIG. 8 that are identical to corresponding components in FIGS. 1-6 are given the same respective reference numerals.

As shown in FIG. 8, a difference between the goggles 10 of FIGS. 1-6 and the goggles 100 is that the latter includes a nose piece 106 that interconnects the adjacent nasal ends of frame portions 18 and an elastic head strap 108 that is connected to the temporal end portions of frame portions 18 and extends around the rear of the head. In this embodiment, the adhesive layer 28 (FIG. 2) would not be desired since the nose piece 106 and head strap 108 function to firmly retain the eyepieces 102, 104 on the head. Like the embodiment shown in FIGS. 1-6, the eyepieces 102, 104 have respective lens portions 16, each of which includes a flat anterior lens 20 and a flat, angled side lens 22 that extends rearwardly and temporally from the anterior lens 20. As mentioned above, the configuration of lens portions 16 provides enhanced optical properties, which are discussed below with reference to FIGS. 9-12.

Figure 11:
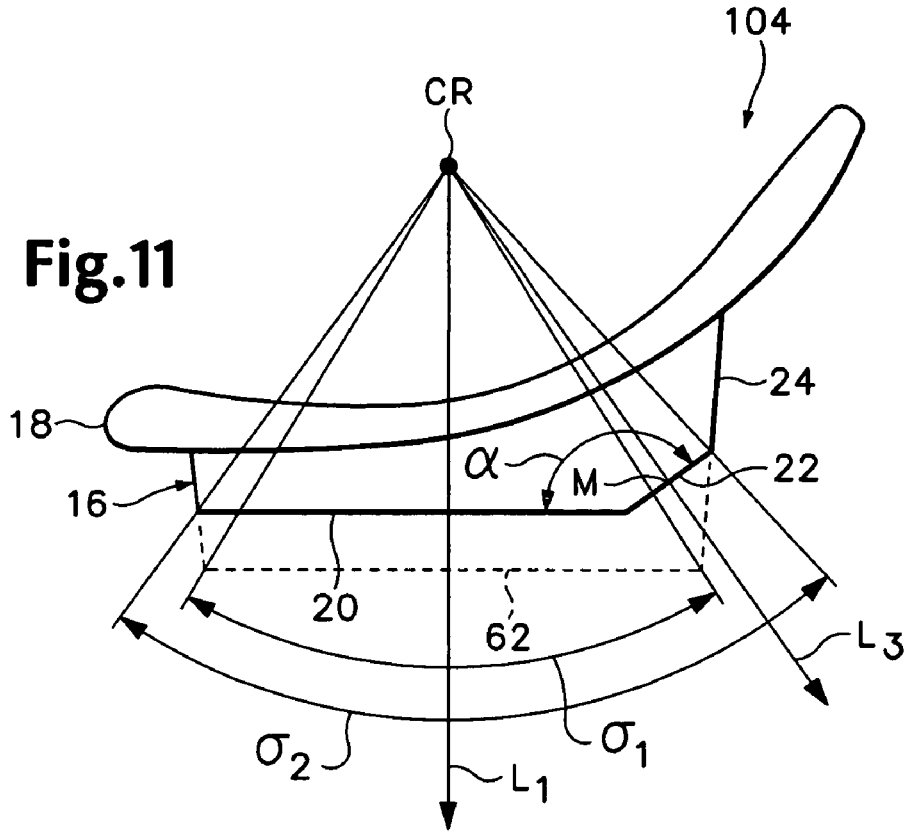
FIG. 11 is a top plan view illustrating the horizontal viewing angle of the left eyepiece of the set of goggles shown in FIGS. 1 and 8 and the left eyepiece of the conventional goggles shown in FIG. 7.
Figure 12:
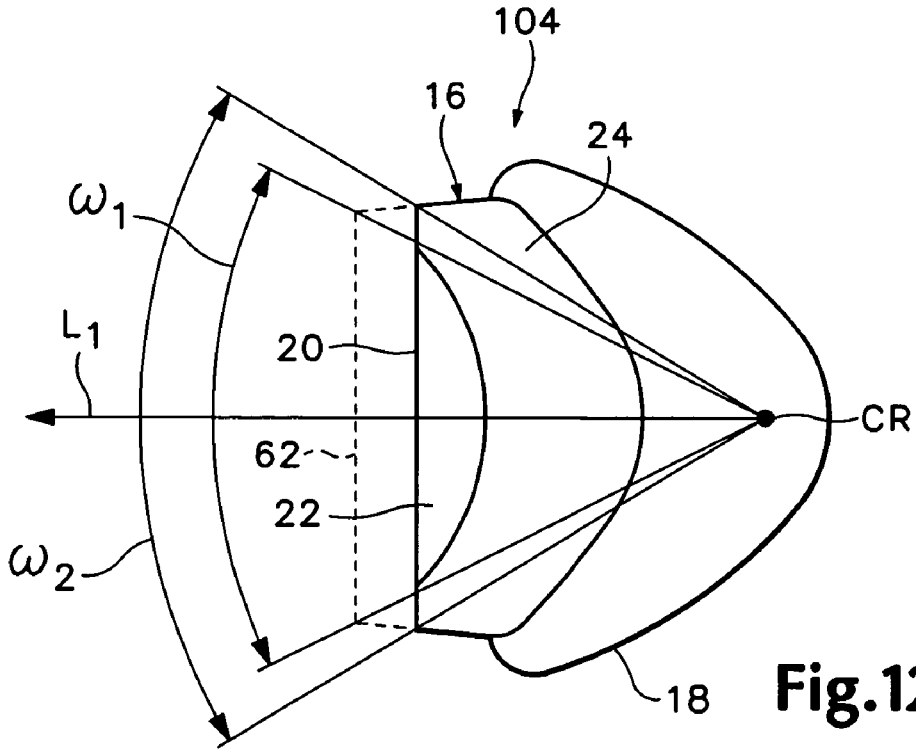
FIG. 12 is a side elevation view illustrating the vertical viewing angle of the left eyepiece of the set of goggles shown in FIGS. 1 and 8 and the left eyepiece of the conventional goggles shown in FIG. 7.

FIG. 11 illustrates the horizontal or lateral viewing angles of an eyepiece 104 having an inclined temporal surface, in contrast to a typical conventional higher profile eyepiece having a flat anterior lens 62, which is shown in phantom. FIG. 12 illustrates the vertical viewing angles of the eyepiece 104 and the conventional eyepiece. As shown in FIG. 11, the conventional lens has a horizontal or lateral viewing angle $\sigma_1$, which is limited by the width of the lens 62 (i.e., the distance between the nasal and temporal ends of lens 62). As shown in FIG. 12, the conventional lens has a vertical viewing angle $\omega_1$, which is limited by the height of the lens 62 (i.e., the distance between the upper and lower edges of lens 62). By moving anterior lens 20 of eyepiece 104 closer to the eye and by employing side lens 22, the lens portion 16 provides a lateral viewing angle $\sigma_2$ that is greater than the lateral viewing angle $\sigma_1$ of the depicted conventional lens. In addition, the lens portion 16 provides a vertical viewing angle $\omega_2$ that is greater than the vertical viewing angle $\omega_1$ of the depicted conventional lens as a consequence of moving the anterior lens 20 closer to the eye.

A typical conventional eyepiece having the lens configuration shown in FIGS. 11 and 12 has a lateral viewing angle $\sigma_1$ of about 55° and a vertical viewing angle $\omega_1$ of about 40°. In comparison, an eyepiece 104 having the dimensions set forth above in Example 1 provides a lateral viewing angle $\sigma_2$ of about 75° and a vertical viewing angle $\omega_2$ of about 45°.

Figure 9:
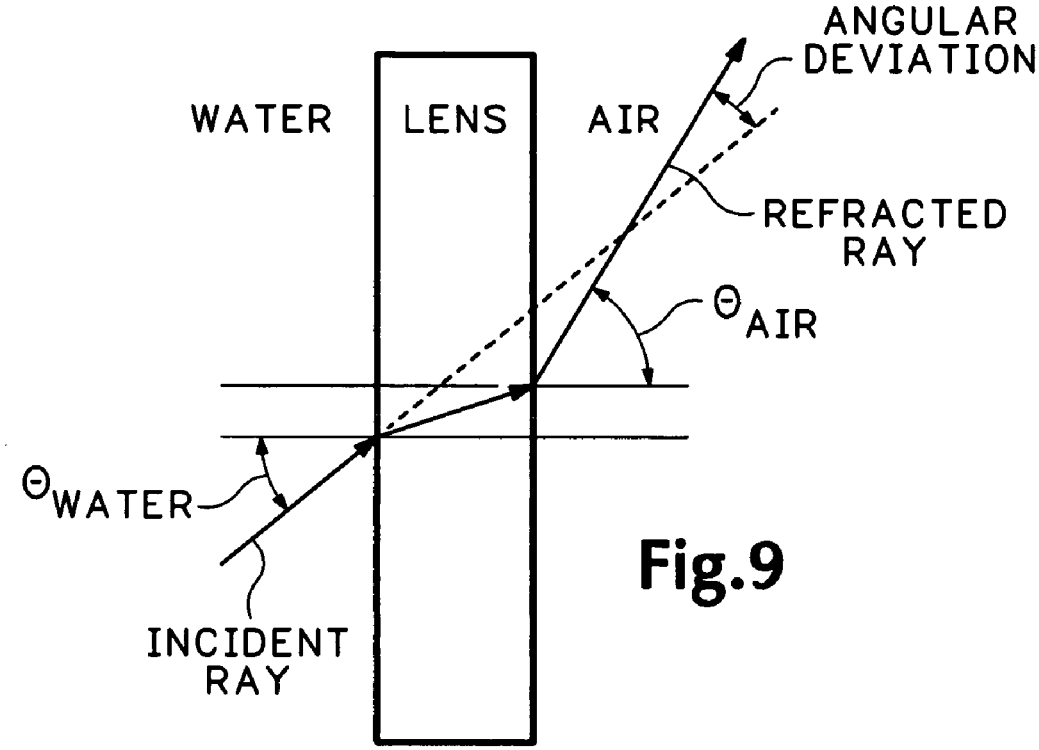
FIG. 9 is a schematic representation of light refraction through a planar lens.

FIG. 9 illustrates the refraction of a light ray passing from water through a planar lens into air. Due to the differences in the indices of refraction of air and water, the lens-air interface produces an angular deviation of the refracted ray with respect to the incident ray. This refracted pathway alters the apparent size and perspective of an object being viewed, causing visual distortion of the viewed image.

Assuming the surfaces of the lens are flat and parallel, the relationship between the incident light ray in water and the refracted light ray in air can be calculated using Snell's Law:

$$n_{air} \cdot \sin \theta_{air} = n_{water} \cdot \sin \theta_{water}$$

where $n_{air}$ and $n_{water}$ are the indices of refraction of air and water, respectively, $\theta_{water}$ is the angle of incidence, and $\theta_{air}$ is the angle of refraction. This equation can be used to calculate either the angle of refraction in water as a function of the angle of incidence or the viewing angle in water ($\theta_{water}$) as a function of the initial line of sight in air ($\theta_{air}$). The angular deviation can be expressed in prism diopters (pd), which can be calculated according to the equation:

$$pd=100\cdot\tan(\theta_{air}-\theta_{water})$$

Combining the above equations, the prismatic deviation (expressed in pd) can be calculated for any initial line of sight in air.

Figure 10:
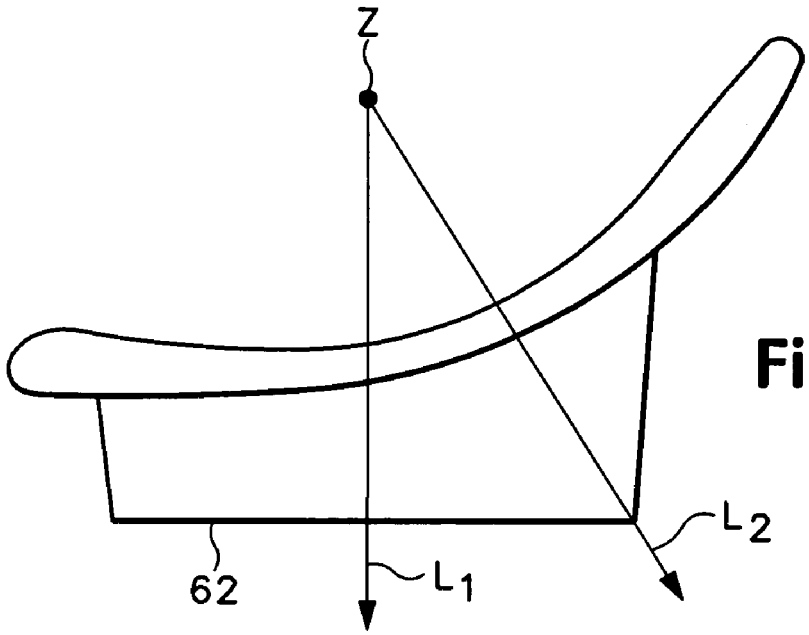
FIG. 10 is a top plan view of the left eyepiece of the conventional goggles shown in FIG. 7 positioned in front of the eye.

Table 2 shows the angle of refraction and prismatic deviation calculated for various angles of incidence. Table 2 illustrates that there is no prismatic deviation if an image is viewed along a direction of gaze, or line of sight, that is perpendicular to the lens surface (i.e., $\theta_{air}=0$), and the amount of prismatic deviation increases as the angle between the line of sight in air ($\theta_{air}$) and a normal to the lens surface increases. For example, FIG. 10 shows a typical conventional eyepiece having a flat anterior lens 62. If the anterior and posterior surfaces of lens 62 are flat and parallel, there is no visual distortion of an image viewed along a line of sight $L_1$ that is perpendicular to the lens 62. As the eye rotates relative to the head and the goggles around the z axis extending through the center of rotation of the eye (the z axis extends perpendicularly into the plane of the page in FIG. 10), either in the temporal or nasal direction, the line of sight deviates from a normal to lens 62 and as a result, the amount of visual distortion increases. For example, the line of sight $L_2$ in FIG. 10 extends through the temporal edge of lens 62 and indicates the line of sight of maximum distortion through the temporal portion of the lens.

TABLE 2

| Angle of Incidence, $\theta_{water}$ (deg) | Angle of Refraction, $\theta_{air}$ (deg) | Angular Deviation, $\theta_{air}$-$\theta_{water}$ (deg) | Prismatic Deviation (pd) |
|---|---|---|---|
| −48.59 | −89.99 | −41.40 | −88.16 |
| −45 | −70.53 | −25.53 | −47.76 |
| −40 | −58.99 | −18.99 | −34.41 |
| −35 | −49.89 | −14.89 | −26.58 |
| −30 | −41.81 | −11.81 | −20.91 |
| −25 | −34.30 | −9.30 | −16.37 |
| −20 | −27.13 | −7.13 | −12.51 |
| −15 | −20.19 | −5.19 | −9.08 |
| −10 | −13.39 | −3.39 | −5.92 |
| −5 | −6.67 | −1.67 | −2.92 |
| 0 | 0.00 | 0.00 | 0.00 |
| 5 | 6.67 | 1.67 | 2.92 |
| 10 | 13.39 | 3.39 | 5.92 |
| 15 | 20.19 | 5.19 | 9.08 |
| 20 | 27.13 | 7.13 | 12.51 |
| 25 | 34.30 | 9.30 | 16.37 |
| 30 | 41.81 | 11.81 | 20.91 |
| 35 | 49.89 | 14.89 | 26.58 |
| 40 | 58.99 | 18.99 | 34.41 |
| 45 | 70.53 | 25.53 | 47.76 |
| 48.59 | 89.99 | 41.40 | 88.16 |

The angled side lens 22 functions to mitigate the effect of prismatic deviation as the line of sight rotates relative to the eyepiece in the temporal direction. More specifically, and referring to FIG. 11, as the eye rotates in the temporal direction and moves the line of sight away from the normal line of sight $L_1$ toward the intersection of anterior lens 20 and side lens 22, the amount of prismatic deviation increases. As the eye continues to rotate so that line of sight rotates from anterior lens 20 into side lens 22, the amount of prismatic deviation actually decreases since the orientation of the side lens reduces the angle between the line of sight and the normal to the respective lens through which the line of sight extends. Hence, the average prismatic deviation across lens 20 and lens 22 is less than the average prismatic deviation across a flat lens having the same lateral viewing angle.

Further, as shown in FIG. 11, to minimize the amount of prismatic deviation across side lens 22, the angle $\alpha$ between side lens 22 and lens 20 is selected such that a temporal line of sight $L_3$ through a midpoint M of the width $W_2$ of side lens 22 is substantially perpendicular to the side lens 22. $L_3$ is a line of sight that extends along the visual axis of the eye when rotated to a temporal position. In this manner, there is little, if any, visual distortion at the midpoint M of side lens 22, and the distortion increases slightly as the line of sight deviates nasally or temporally from the midpoint. Of course, the line of sight $L_3$ through midpoint M may be slightly angled with respect to the normal depending on the particular facial morphology of the user.

The angle $\alpha$ at which the line of sight $L_3$ is perpendicular to side lens 22 can vary depending on the overall depth or other dimensions of the eyepiece. In particular embodiments, the angle $\alpha$ is approximately 124° to 164°, although the angle could be less than 124° or greater than 164°. In a specific implementation, an eyepiece having the dimensions provided above in Example 1 includes a side lens 22 oriented at an angle $\alpha$ of approximately 142° to 146°, and more particularly 144°. For an eyepiece having the same overall dimensions but a greater depth, the angle $\alpha$ is increased so that the respective line of sight $L_3$ that intersects the midpoint M of the side lens extends at a 90° angle with respect to the lens. Conversely, for an eyepiece having the same overall dimension but a smaller depth, the angle $\alpha$ is decreased to provide a respective line of sight $L_3$ that intersects the midpoint M at a 90° angle.

Other approaches can be used to determine an optimum angle $\alpha$. For example, if the goggles are to be used for activities in which the eyes are substantially fixed relative to the head and the goggles, the angle $\alpha$ can be selected such that a peripheral reflected ray extending through the nodal point of the eye intersects the midpoint M at a 90° angle.

As discussed above, one or more inclined lenses can be connected to other locations on the anterior lens 20. For example, one or more lenses can be connected to the anterior lens and inclined away from the anterior lens in one of the other cardinal directions (superior, superior-temporal, superior-nasal, nasal, inferior, inferior-temporal, and inferior-nasal) or in a direction intermediate two of the cardinal directions. The enhanced optical characteristics of side lens 22 are also realized by other inclined lens connected to other locations on the anterior lens. For example, an inferiorly inclined lens connected to an inferior edge of the anterior lens 20 reduces prismatic deviation and distortion through the inferior portion of the lens portion 16. In addition, the methods described above for determining the optimum angle $\alpha$ for side lens 22 also apply for determining the optimum angle for other inclined lenses connected to the anterior lens.

The present invention has been shown in the described embodiments for illustrative purposes only. The present invention may be subject to many modifications and changes without departing from the spirit or essential characteristics thereof. We therefore claim as our invention all such modifications as come within the spirit and scope of the following claims.

We claim:

1. Swim goggles comprising a pair of unconnected eyepieces, each eyepiece adapted to provide a water-tight seal around an eye of a user during use of the goggles, wherein each eyepiece has a minimum depth of less than 8 mm measured at locations above and below the eyes when the eyepieces are in an as worn orientation, and wherein each eyepiece comprises a flat anterior lens portion that is positioned in front of an eye in an as worn orientation and a flat side lens portion that extends rearwardly and temporally from the anterior lens portion at an obtuse angle.

2. The goggles of claim 1, wherein each eyepiece has a minimum depth of about 5.75 mm or less.

3. The goggles of claim 1, wherein each eyepiece has a layer of adhesive tape for adhesively securing the eyepiece to the skin.

4. The goggles of claim 3, wherein:

each eyepiece comprises a frame portion surrounding the lens portion and the peripheral wall of the eyepiece, the frame portion of each eyepiece having a posterior surface; and each layer of adhesive tape comprises a deformable layer that is secured to the posterior surface of a respective frame and has an adhesive surface for adhering to the skin.

5. The goggles of claim 1, wherein each eyepiece comprises a frame portion, wherein the eyepieces can be retained in place by contracting the orbicularis oculi muscles against the frame portions.

6. The goggles of claim 1, wherein:

each eyepiece comprises an annular peripheral wall that surrounds a respective anterior lens portion and side lens portion and extends rearwardly therefrom; and wherein the side lens portion of each eyepiece intersects a respective anterior lens portion at a line extending between opposing points on the periphery of the side lens portion defining a maximum width of the side lens portion in the superior-inferior direction.

7. The goggles of claim 1, wherein each eyepiece comprises a peripheral flange surrounding the lens portion and the peripheral wall, the flange being shaped to generally conform to the shape of an orbital rim.

8. The goggles of claim 7, wherein each peripheral flange is sized and shaped to fit at least partially within a respective orbital rim.

9. The goggles of claim 8, wherein each peripheral flange has an upper nasal portion and a lower nasal portion that fit within a respective orbital rim.

10. The goggles of claim 9, wherein each peripheral flange has a lower temporal portion that fits at least partially within a respective orbital rim.

11. An eyepiece for swim goggles comprising a body adapted to be worn over only one eye of a user and form a water-tight seal around the eye that isolates the eye from the surrounding environment during use, the water-tight seal formed by an adhesive layer that, in conjunction with a layer of deformable material, adhesively secures the body to the skin of the user in close proximity to the eye, the body comprising a transparent lens portion that includes a first, flat anterior lens that is positioned in front of the eye in an as worn orientation and at least a second, flat lens comprising flat and parallel opposed surfaces, the second lens being connected to the anterior lens at an obtuse angle and extending rearwardly therefrom, wherein the second lens reduces prismatic distortion of the lens portion and is connected to the anterior lens at an angle of approximately 124° to 164°.

12. The eyepiece of claim 11, wherein the second lens is a side lens that extends rearwardly and temporally from the anterior lens, wherein the side lens reduces hydrodynamic drag of the eyepiece and prismatic distortion of the lens portion.

13. The eyepiece of claim 12, wherein the side lens is connected to the anterior lens at an angle at which a line of sight extends perpendicularly with respect to the side lens whenever the eye is rotated temporally to a position at which the visual axis intersects a midpoint of the side lens.

14. The eyepiece of claim 11, wherein the body includes a frame portion that is coupled to the lens portion and is shaped to generally conform to the shape of the orbital rim.

15. An eyepiece for swim goggles comprising a body adapted to be worn over the eye of a user and form a water-tight seal around the eye that isolates the eye from the surrounding environment during use, the body comprising a transparent lens portion that includes a first, flat anterior lens that is positioned in front of the eye in an as worn orientation and at least a second, flat lens comprising flat and parallel opposed surfaces, the second lens being connected to the anterior lens at an obtuse angle and extending rearwardly therefrom, wherein the second lens reduces prismatic distortion of the lens portion and is connected to the anterior lens at an angle of approximately 124° to 164°;

wherein the second lens is a side lens that extends rearwardly and temporally from the anterior lens, wherein the side lens reduces hydrodynamic drag of the eyepiece and prismatic distortion of the lens portion;

wherein the side lens is connected to the anterior lens at an angle at which a line of sight extends perpendicularly with respect to the side lens whenever the eye is rotated temporally to a position at which the visual axis intersects a midpoint of the side lens;

wherein the body comprises a frame portion surrounding the first and second lenses and the eyepiece further comprises a piece of double-sided tape having a first adhesive surface adhering to a posterior surface of the frame and a second adhesive surface for adhering to skin substantially surrounding the eye.

16. An eyepiece for swim goggles comprising:

a body adapted to be worn over only one eye of a user and form a water-tight seal around the eye that isolates the eye from the surrounding environment during use, the water-tight seal formed by an adhesive layer that, in conjunction with a layer of deformable material, adhesively secures the body to the skin of the user in close proximity to the eye;

the body comprising a transparent lens portion that includes a first, flat anterior lens that is positioned in front of the eye in an as worn orientation and at least a second, flat lens connected to the anterior lens at an obtuse angle and extending rearwardly therefrom, wherein the second lens reduces prismatic distortion of the lens portion;

wherein the second lens is a side lens that extends rearwardly and temporally from the anterior lens, wherein the side lens reduces hydrodynamic drag of the eyepiece and prismatic distortion of the lens portion;

wherein the side lens is connected to the anterior lens at an angle at which a line of sight extends perpendicularly with respect to the side lens whenever the eye is rotated temporally to a position at which the visual axis intersects a midpoint of the side lens;

wherein the side lens is connected to the anterior lens at an angle of about 144°.

17. An eyepiece for swim goggles comprising a body adapted to be worn over the eye of a user and form a water-tight seal around the eye that isolates the eye from the surrounding environment during use, the body comprising a transparent lens portion that includes a first, flat anterior lens that is positioned in front of the eye in an as worn orientation and at least a second, flat lens comprising flat and parallel opposed surfaces, the second lens being connected to the anterior lens at an obtuse angle and extending rearwardly therefrom, wherein the second lens reduces prismatic distortion of the lens portion and is connected to the anterior lens at an angle of approximately 124° to 164°;

wherein the body includes a frame portion that is coupled to the lens portion and is shaped to generally conform to the shape of the orbital rim;

wherein the frame portion has an adhesive layer that adhesively secures the eyepiece to the skin of the user in close proximity of the eye.

18. Swim goggles comprising a pair of eyepieces, each eyepiece being shaped to provide a water-tight seal around only one eye of a user during use of the goggles, the water-tight seal formed by an adhesive layer that, in conjunction with a layer of deformable material, adhesively secures the body to the skin of the user in close proximity to the eye, each eyepiece having a flat, transparent anterior lens that is positioned in front of a respective eye in an as worn orientation and a flat, transparent side lens connected to and inclined away from a respective anterior lens in a temporal direction so as to reduce hydrodynamic drag and prismatic distortion of the respective eyepiece, wherein the side lens of each eyepiece intersects a respective anterior lens at a line extending between opposing points on the periphery of the side lens defining a maximum width of the side lens in the superior-inferior direction, wherein the side lens is oriented with respect to the anterior lens such that a line of sight along the visual axis intersects the side lens at 90 degrees whenever the eye is rotated to a temporal position at which the visual axis intersects the side lens, wherein said line of sight extends through a midpoint of the side lens, and wherein the side lens is connected to the anterior lens at an angle of approximately 124° to 164°.

19. The swim goggles of claim 18, wherein the side lens is connected to the anterior lens at an angle of about 144°.

20. The swim goggles of claim 18, wherein each eyepiece further comprises:

an annular side wall surrounding a respective anterior lens and side lens and extending rearwardly therefrom; and a posterior frame portion connected to a respective side wall opposite the anterior lens and side lens, the frame portion being shaped to form a water-tight seal around an eye.

21. The swim goggles of claim 18, further comprising:

a nose piece connecting adjacent nasal end portions of the eyepieces and dimensioned to extend over the user's nose; and a head strap connected to respective temporal end portions of the eyepieces and dimensioned to extend around the rear of the user's head.

22. An eyepiece for swim goggles comprising:

a protective body adapted to be worn over an eye of a user, the body comprising a transparent lens portion, a peripheral wall surrounding the lens portion and extending rearwardly therefrom, and a frame portion surrounding the peripheral wall and shaped to generally conform to the shape of an orbital rim of the eye; and an adhesive layer that adhesively secures the frame portion to the skin of the user in close proximity to the eye so as to form a substantially water-tight seal around the eye that substantially isolates the eye from the surrounding environment during use, and wherein the lens portion comprises a flat, anterior lens that is positioned in front of the eye in an as worn orientation and a flat side lens connected to and inclined away from the anterior lens in a temporal direction.

23. The eyepiece of claim 22, wherein the side lens intersects the anterior lens at a line extending in the superior-inferior direction from a point on the periphery of the side lens to an opposing point on the periphery of the side lens, the line defining a maximum width of the side lens in the superior-inferior direction.

24. The eyepiece of claim 22, wherein the adhesive layer comprises double-sided tape having a first adhesive surface adhesively secured to a posterior surface of the frame portion and a second adhesive surface that adhesively secures the frame portion to the skin.

25. The eyepiece of claim 22 wherein the frame portion has a curved, concave posterior surface.

26. An eyepiece for swim goggles comprising:

a protective body adapted to be worn over only one eye of a user and form a water-tight seal around the eye that isolates the eye from the surrounding environment during use;

the body comprising a transparent lens portion including a flat, anterior lens that is positioned in front of the eye in an as worn orientation and a flat side lens connected to and inclined away from the anterior lens in a temporal direction, the body also comprising an annular peripheral wall surrounding the anterior lens and the side lens and extending rearwardly therefrom, and a frame portion surrounding the peripheral wall and shaped to generally conform to the shape of an orbital rim of the eye; and an adhesive layer that, in conjunction with a layer of deformable material, adhesively secures the frame portion of the skin of the user in close proximity to the eye, wherein the side lens intersects the anterior lens at a line extending in the superior-inferior direction from a point on the periphery of the side lens to an opposing point on the periphery of the side lens, the line defining a maximum width of the side lens in the superior-inferior direction, and wherein the side lens is connected to the anterior lens at an angle of approximately 124° to 164°.

27. The eyepiece of claim 26, wherein the side lens is connected to the anterior lens at an angle of about 144°.

* * * * *